US011174712B2

(12) United States Patent
Quattlebaum et al.

(10) Patent No.: US 11,174,712 B2
(45) Date of Patent: Nov. 16, 2021

(54) DETONATOR ASSEMBLY FOR WELLBORE PERFORATOR

(71) Applicant: Halliburton Energy Services, Inc., Houston, TX (US)

(72) Inventors: Clinton Carter Quattlebaum, Spring, TX (US); Darren Philip Walters, Tomball, TX (US); Stuart Wood, Kingwood, TX (US); Kevin Harive, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 25 days.

(21) Appl. No.: 16/643,799

(22) PCT Filed: Nov. 14, 2017

(86) PCT No.: PCT/US2017/061516

§ 371 (c)(1),
(2) Date: Mar. 2, 2020

(87) PCT Pub. No.: WO2019/098990

PCT Pub. Date: May 23, 2019

(65) Prior Publication Data

US 2020/0199982 A1 Jun. 25, 2020

(51) Int. Cl.
*E21B 43/117* (2006.01)
*E21B 43/1185* (2006.01)
(Continued)

(52) U.S. Cl.
CPC ..... *E21B 43/1185* (2013.01); *E21B 43/117* (2013.01); *E21B 47/06* (2013.01); *E21B 47/07* (2020.05)

(58) Field of Classification Search
CPC .... E21B 43/117; E21B 43/1185; E21B 47/06; E21B 47/07
See application file for complete search history.

(56) References Cited

U.S. PATENT DOCUMENTS 5,027,708 A * 7/1991 Gonzalez ..... F42D 1/04 102/254
8,113,119 B2 2/2012 Crawford
(Continued)

FOREIGN PATENT DOCUMENTS

WO 2013180765 A1 12/2013
WO 2015157532 A1 10/2015

OTHER PUBLICATIONS

International Search Report and Written Opinion dated Aug. 13, 2018; International PCT Application No. PCT/US2017/061516.

*Primary Examiner* — Daniel P Stephenson
(74) *Attorney, Agent, or Firm* — McGuireWoods LLP

(57) ABSTRACT

The disclosed embodiments include a perforating gun assembly. The perforating gun assembly includes a housing and at least one perforating charge disposed within the housing. Additionally, the perforating gun assembly includes a detonating cord disposed within the housing and ballistically coupled to the at least one perforating charge. Also included in the perforating gun assembly is a detonator assembly disposed in line or adjacent to the detonating cord. The detonator assembly includes a detonator, a ballistic interrupt, an actuator to remove the ballistic interrupt from a line of fire of the detonator, and a detonator control board to control the actuator and firing of the detonator.

20 Claims, 2 Drawing Sheets

(51) Int. Cl.
*E21B 47/07* (2012.01)
*E21B 47/06* (2012.01)

(56) References Cited

U.S. PATENT DOCUMENTS

| | | | | |
|---|---|---|---|---|
| 10,077,641 | B2 * | 9/2018 | Rogman | E21B 43/1185 |
| 10,876,381 | B2 * | 12/2020 | Walters | E21B 43/117 |
| 2009/0084535 | A1 * | 4/2009 | Bertoja | E21B 43/11857 166/55.2 |
| 2009/0159285 | A1 | 6/2009 | Goodman | |
| 2012/0199031 | A1 * | 8/2012 | Lanclos | E21B 43/1185 102/206 |
| 2012/0247771 | A1 * | 10/2012 | Black | E21B 43/1185 166/297 |
| 2014/0138090 | A1 * | 5/2014 | Hill | E21B 43/1185 166/297 |
| 2014/0231065 | A1 | 8/2014 | Mason et al. | |
| 2015/0330192 | A1 | 11/2015 | Rogman et al. | |
| 2016/0084048 | A1 * | 3/2016 | Harrigan | E21B 43/117 175/4.57 |
| 2019/0368321 | A1 * | 12/2019 | Eitschberger | E21B 43/117 |
| 2020/0018139 | A1 * | 1/2020 | Eitschberger | E21B 43/117 |
| 2020/0199982 | A1 * | 6/2020 | Quattlebaum | E21B 43/117 |

* cited by examiner

DETONATOR ASSEMBLY FOR WELLBORE PERFORATOR

BACKGROUND

The present disclosure relates generally to downhole perforating guns used within a well, and more specifically to a detonator assembly used to detonate the downhole perforating guns.

When transporting downhole perforating guns between a gun loading facility and a well site for final use, certain precautions are taken. For example, the downhole perforating guns may include removable ballistic interrupts between detonators and detonating cords of the downhole perforating guns. The removable ballistic interrupt is manually removed prior to deploying the downhole perforating gun within a well. This removal of the ballistic interrupt leads to additional operational steps and manual handling of an armed perforating gun.

BRIEF DESCRIPTION OF THE DRAWINGS

Illustrative embodiments of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to a perforating gun that punches holes in a casing at a downhole location. More particularly, the present disclosure relates to a detonator assembly that enables transport of the perforating gun while the detonator assembly is attached and reduces manual handling of armed perforating guns. The presently disclosed embodiments may be used in horizontal, vertical, deviated, or otherwise nonlinear wellbores in any type of subterranean formation. Embodiments may be implemented in completions operations to perforate a casing prior to production.

Figure 1:
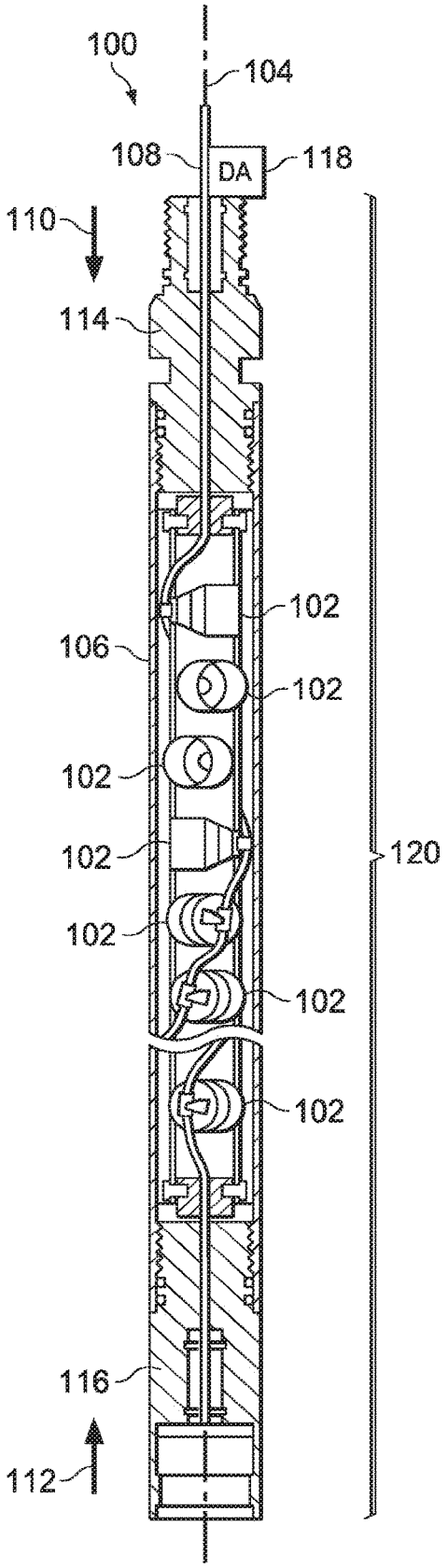
FIG. 1 is a sectional view of a perforating gun assembly including a detonator assembly.

Referring to FIG. 1, a schematic illustration of a perforating gun assembly 100 is provided. The perforating gun assembly 100 includes a plurality of charges 102 that are aimed in various directions radially outward from a longitudinal axis 104 of the perforating gun assembly 100. In other embodiments, the plurality of charges 102 may all be aimed in a single direction facing radially outward from the longitudinal axis 104. The charges 102 include high explosives that are shaped to produce a pressure punch capable of punching holes in a casing within a well. In an embodiment, the pressure punch is capable of punching holes in steel, cement, rock formations, or any other surfaces that the pressure punch of the charges 102 may come in contact with in a downhole well. The perforating gun assembly 100 also includes a housing 106 that provides structural support to the perforating gun assembly 100. Further, the housing 106 houses detonating cord 108 located within the perforating gun assembly 100 used to detonate the charges 102. The detonating cord 108 is ballistically coupled to the charges 102 to initiate firing of the charges 102.

The perforating gun assembly 100 may be fired in a top down manner, as indicated by arrow 110, or in a bottom up manner, as indicated by arrow 112. Top down fire (e.g., in the direction of the arrow 110) of the perforating gun assembly 100 is used to have a detonation wave move from an uphole coupling 114 to a downhole coupling 116 of the perforating gun assembly 100. This configuration reduces wire feed through in the gun assembly 100. The top down fire configuration also reduces the ability to select fire a section of the perforating gun assembly 100 when multiple sections of the perforating gun assembly 100 are stacked. Bottom up firing of the perforating gun assembly 100, for example, allows the ability to select fire each section 120 of the perforating gun assembly 100 in an order moving from a furthest downhole section 120 of the perforating gun assembly 100 to the most uphole section of the perforating gun assembly 100 on command. The detonation wave will move from the downhole coupling 116 of the perforating gun assembly 100 to the uphole coupling 114 of the perforating gun assembly 100.

In a top down firing of the perforating gun assembly 100, the detonating cord 108 may be positioned within the uphole coupling 114 and adjacent and/or coupled to a detonator assembly 118, as discussed in detail below with reference to FIGS. 3 and 4. In a bottom up firing of the perforating gun assembly 100, a signal cord may extend from a surface of a wellbore through the perforating gun assembly 100 to a detonator assembly 118 positioned at or near the downhole coupling 116 to provide firing signals to the detonator assembly 118 for firing the detonating cord 108. In an embodiment, the signal cord may run within the housing 106 of the perforating gun assembly 100 to the detonator assembly 118 located at the downhole coupling 116 in a bottom up firing arrangement.

The perforating gun assembly 100 may include multiple sections 120 coupled end over end. For example, each of the sections 120 include an uphole coupling 114 and a downhole coupling 116. The uphole coupling 114 of one section couples to a downhole coupling 116 of a different section. Accordingly, the perforating gun assembly 100 is customizable based on a number of charges 102 desired at a downhole location within the wellbore. Additionally, in an embodiment, only a single detonator assembly 118 is included for a group of sections 120 that make up the perforating gun assembly 100. In such an embodiment, the detonator assembly 118 is removable and attachable to any individual section 120. In another embodiment, each of the sections 120 include a detonator assembly 118 that detonates the detonating cord 108 of the individual section 120.

Figure 2:
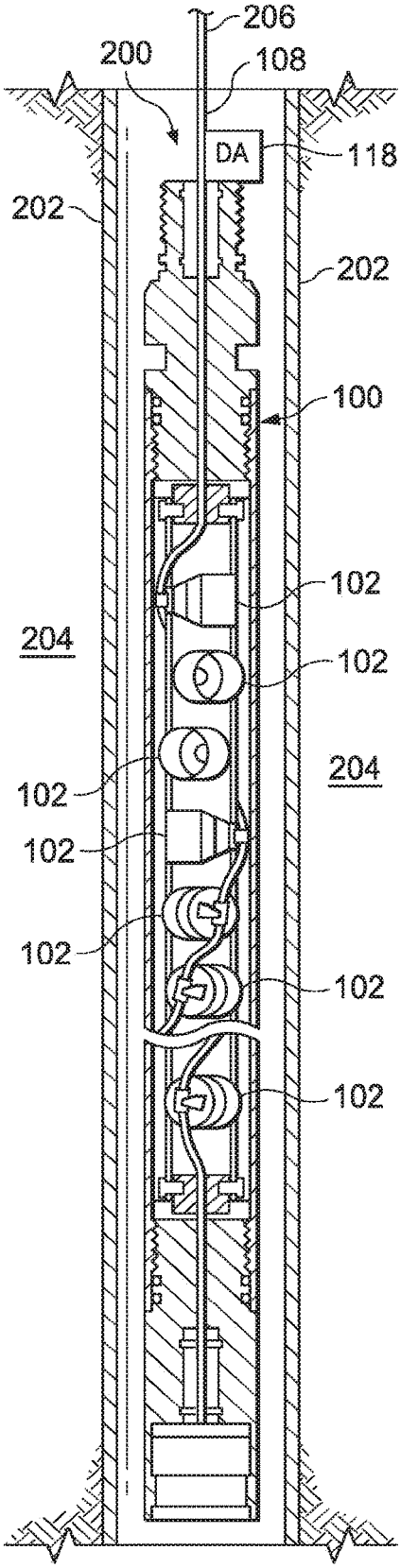
FIG. 2 is a sectional view of the perforating gun assembly of FIG. 1 within a wellbore.

FIG. 2 is a schematic view of the perforating gun assembly 100 within a wellbore 200. The perforating gun assembly 100 is positioned within a wellbore casing 202. In an embodiment, the charges 102 of the perforating gun assembly 100 are positioned in close proximity with the wellbore casing 202 such that the charges 102 punch holes in the wellbore casing 202 when fired. The positioning of the charges 102 in relation to the wellbore casing 202 may be such that when the charges 102 punch through the wellbore casing 202, effective flow communication is provided between the wellbore 200 and a geological formation 204. As used herein, the term "close proximity" means that the charges 102 are positioned closer to the wellbore casing 202 than ten percent of a diameter of the wellbore casing 202. In other embodiments, a perforating gun assembly 100 may be used with a diameter sufficiently smaller than a diameter of the wellbore casing 202 such that not all of the charges 102 are positioned in close proximity with the wellbore casing 202. In such an embodiment, some or all of the charges 102 may still be capable of punching holes in the wellbore casing 202 when fired.

The perforating gun assembly 100 may be fed into the wellbore 200 using a wireline 206. In some embodiments, the wireline 206 may be replaced with a slickline, or the perforating gun assembly 100 may be conveyed by pipe. In an embodiment, the wireline 206 provides a signal to the detonator assembly 118 coupled to the perforating gun assembly 100. Upon receiving a detonate signal from the wireline 206, the detonator assembly 118 detonates the detonating cord 108. The detonating cord 108 detonates the charges 102 of the perforating gun assembly 100 to punch the wellbore casing 202.

Figure 3:
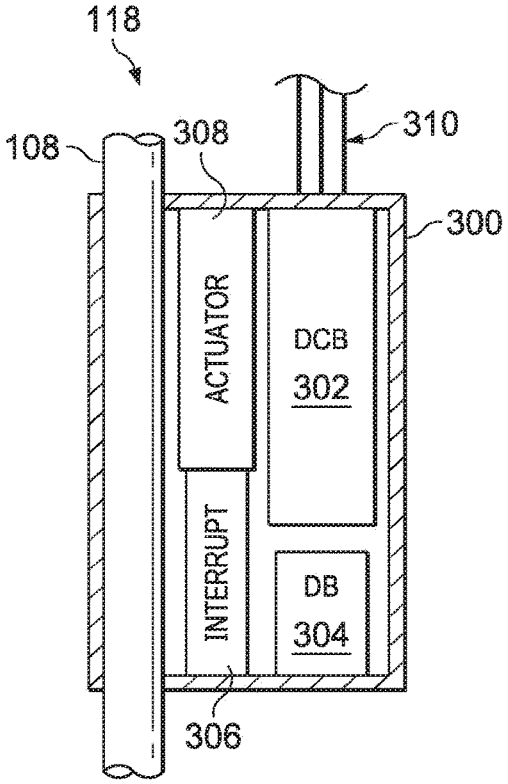
FIG. 3 is a schematic view of the detonator assembly of FIG. 1 in an unarmed state.

Referring to FIG. 3, a schematic view of the detonator assembly 118 in an unarmed state is depicted. As illustrated, the detonator assembly 118 includes a housing 300. A detonator circuit board 302 and detonator ballistics 304 are stored within the housing 300. Additionally, a ballistic interrupt 306 and an actuator 308 are included within the housing 300. The detonator circuit board 302 receives control signals from electrical control paths 310, which may originate from the wireline 206. The control signals, which may control firing of the detonator ballistics 304 and actuation of the actuator 308, are provided to the detonator circuit board 302 from an operator at the surface of the wellbore 200. In another embodiment, the detonator circuit board 302 may control firing of the detonator ballistics 304 and actuation of the actuator 308 automatically based on pressure sensing, temperature sensing, liquid sensing, or time from deployment of the perforating gun assembly 100

The actuator 308 controls movement of the ballistic interrupt 306. As depicted in FIG. 3, the ballistic interrupt 306 is in a failsafe closed position. In the closed position, the ballistic interrupt 306 blocks ballistic transfer from the detonator ballistics 304 to the detonating cord 108 when the detonator ballistics 304 are fired. In blocking the ballistic transfer, the perforating gun assembly 100 is maintained in a mode that prevents initiation of the charges 102. Accordingly, the detonator assembly 118, which includes the detonator ballistics 304, may be stored and transported while coupled to the perforating gun assembly 100 absent the chance of an unplanned discharge of the detonating cord 108. When firing of the perforating gun assembly 100 is desired, the control signals from the electrical control paths 310 instruct the detonator circuit board 302 to control the actuator 308 to remove the ballistic interrupt 306 from a line of fire of the detonator ballistics 304, as discussed in detail below with respect to FIG. 4.

The ballistic interrupt 306 may be made from any material suitable to block a ballistic transfer from the detonator ballistics 304 to the detonating cord 108. For example, the ballistic interrupt 306 may be made from a sheet of aluminum that extends between the actuator 308 and the housing 300 and is positioned between the detonator ballistics 304 and the detonating cord 108. Alternatively, the ballistic interrupt 306 may be made from other metals, a polymeric material, an elastomeric material, or any other material suitable for preventing the ballistic transfer from the detonator ballistics 304 to the detonating cord 108. Because the ballistic interrupt 306 is maintained in an unarmed position until embedded digital logic is used to transition the ballistic interrupt 306 to an armed position, the detonator assembly 118 is maintained in a failsafe state until the detonator assembly 118 is armed.

Figure 4:
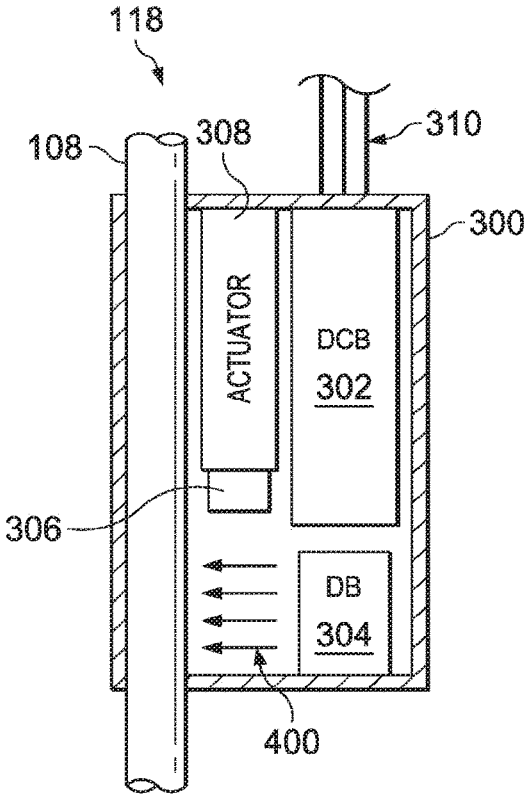
FIG. 4 is a schematic view of the detonator assembly of FIG. 3 in an armed state.

FIG. 4 is a schematic view of the detonator assembly 118 in an armed state. The detonator assembly 118 reaches the armed state when the ballistic interrupt 306 is removed from a line of fire 400 of the detonator ballistics 304. The actuator 308 may be an electromechanical actuator with a motor that mechanically transports the ballistic interrupt 306 away from the line of fire 400 of the detonator ballistics 304. In another embodiment, the actuator 308 may be spring actuated to maintain the ballistic interrupt 306 in the unarmed position of FIG. 3 until the detonator control board 302 provides a signal to release a spring of the actuator 308 to remove the ballistic interrupt 306 from the line of fire 400. The actuator 308 may also include other actuator styles sufficient to remove the ballistic interrupt 306 from the line of fire 400.

In an embodiment, the actuator 308 may be controlled using command and control signals from the detonator control board 302. In such an embodiment, the control signals are provided to the detonator control board 302 by way of the electrical control paths 310. In another embodiment, the actuator 308 may be controlled using analog control that provides control signals to the detonator control board 302 automatically based on pressure sensing, temperature sensing, liquid sensing, or time from deployment of the perforating gun assembly 100. For example, the detonator control board 302 may be programmed to automatically actuate the actuator 308 to an armed position and subsequently fire the detonator ballistics 304 when the perforating gun assembly 100 experiences a certain pressure, temperature, liquid type, time from deployment, or any combination thereof that provides the perforating gun assembly 100 with an indication that the perforating gun assembly 100 is in an appropriate location within the wellbore 200. Once the actuator 308 removes the ballistic interrupt 306 from the line of fire 400, the detonator ballistics 304 are available to detonate the detonating cord 108, which triggers firing of the charges 102.

In other embodiments, the ballistic interrupt 306 may be replaced with a distance barrier configuration. In such an embodiment, instead of the actuator 308 controlling the ballistic interrupt 306 into and out of the line of fire 400, the actuator 308 controls the detonator ballistics 304 toward or away from the detonating cord 108. For example, in the embodiment illustrated in FIG. 4, the detonator ballistics 304 may be maintained within an quarter inch or a half inch from the detonating cord 108 such that the detonator ballistics 304 will detonate the detonating cord 108 upon firing of the detonator ballistics 304 while the ballistic interrupt 306 is actuated away from the line of fire 400. When the distance barrier configuration is implemented in the detonator assembly 118, the detonator ballistics 304 may be maintained in an unarmed state at a distance of a half inch to three or more inches from the detonating cord 108. In such a configuration, the distance of the detonator ballistics 304 from the detonating cord 108 prevents the capability of the detonator ballistics 304 from detonating the detonating cord 108 when the detonator ballistics 304 are fired. When the detonator assembly 118 is moved into an armed state, the actuator 308 moves the detonator ballistics 304 toward the detonating cord 108 to a distance within a half inch of the detonating cord 108. Once in the armed state, the detonator ballistics 304 are sufficiently close to the detonating cord 108 to detonate the detonating cord 108 upon firing of the detonator ballistics 304. As used herein, the term ballistic barrier may refer to either the ballistic interrupt 306 or the distance barrier.

Additional embodiments include a top down firing of the detonating cord 108 using either a ballistic interrupt configuration, as depicted in FIGS. 3 and 4, or using the distance barrier configuration described above. In either case, the detonator assembly 118 may be positioned such that the detonator ballistics 304 fire in a downhole direction toward the detonating cord 108, as opposed to in a wellbore wall facing direction as depicted in FIGS. 3 and 4. Such an embodiment may include the detonator ballistics 304 having the line of fire 400 in line with the detonating cord 108, as opposed to the side fire arrangement of FIGS. 3 and 4. In other embodiments, the detonator assembly 118 may also be positioned at the downhole coupling 116 of the perforating gun assembly 100. Such a configuration may be used for a bottom up firing configuration of the perforating gun assembly 100.

Additionally, in any of the embodiments, multiple sections 120 of the perforating gun assembly 100 may be stacked to provide extended perforating capabilities within the wellbore 200. In embodiments with multiple sections 120, a single detonator assembly 118 may provide the detonating force to the detonating cord 108 for all of the sections 120 of the perforating gun assembly 100. In other embodiments with multiple sections 120, a detonator assembly 118 may be deployed at each section 120 or at multiple sections 120 of the perforating gun assembly 100. When multiple detonator assemblies 118 are deployed on a string of multiple sections 120 of the perforating gun assembly 100, each of the detonator assemblies 118 may be uniquely addressable. That is, each of the detonator assemblies 118 may be individually controlled to initiate firing of just a single section 120 or group of sections 120 of the perforating gun assembly 100 without firing the entire string of sections 120.

In any of the embodiments, the perforating gun assembly 100 or sections 120 of the perforating gun assembly 100 may be transported with the detonator assemblies 118 coupled to the perforating gun assembly 100. Because the ballistic interrupt configuration and the distance barrier configuration prevent incidental detonation of the detonating cord 108, operators are able to handle and transport the completed perforating gun assembly 100.

Figure 5:
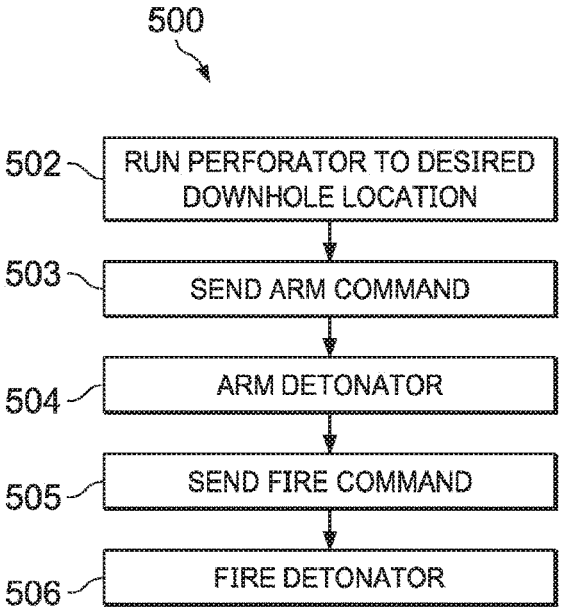
FIG. 5 is a flow-chart of a method of operating the perforating gun assembly of FIG. 1.

FIG. 5 is a flow-chart of a method 500 of operating the perforating gun assembly 100. Initially, at block 502, the perforating gun assembly 100 is run within the wellbore 200 to a desired location within the wellbore 200. Reaching the desired location within the wellbore 200 may be determined based on wellbore pressure at the perforating gun assembly 100, wellbore temperature at the perforating gun assembly 100, run time and speed of the perforating gun assembly 100, fluid composition at the perforating gun assembly 100, or any other metric that enables an operator to determine a position of the perforating gun assembly 100 within the wellbore 200.

Once the perforating gun assembly 100 reaches the desired location within the wellbore 200, an arm command is sent to the detonator assembly 118 using control signals from the electrical control path 310 at block 503. The arm command may be sent by a user remotely using the electrical control path 310 or by a smart device that provides the command through a predetermined setup (e.g., when a temperature, pressure, time from deployment of the perforating gun assembly 100, etc. is observed at the perforating gun assembly 100). The arm command is provided to the detonator control board 302.

Upon receiving the arm command, the detonator assembly 118 is armed at block 504. Arming the detonator assembly 118 may also occur as soon as the perforating gun assembly 100 is below the surface of the well within the wellbore 200. Arming the detonator assembly 118 may involve removing the ballistic interrupt 306 from the line of fire 400 of the detonator ballistics 304. Removing the ballistic interrupt 306 from the line of fire 400 enables the detonator ballistics 304 to detonate the detonating cord 108 to fire the charges 102 of the perforating gun assembly 100. In a distance barrier configuration of the detonator assembly 118, arming the detonator assembly 118 may involve moving the detonator ballistics 304 to a position close enough to the detonating cord 108 to detonate the detonating cord 108 when firing the detonator ballistics 304. In such an embodiment, the detonator ballistics 304 may move from a distance sufficiently far away from the detonating cord 108 to not detonate the detonating cord 108 when the detonator ballistics 304 are fired, to the closer position that is within a distance that will detonate the detonating cord 108 when the detonator ballistics 304 are fired.

After the detonator assembly 118 is armed, the detonator assembly 118 receives a fire command at block 505. The fire command may originate from the control signals received from the surface using the electrical control path 310 and provided to the detonator control board 302. Upon receiving the fire command, the detonator assembly 118 is fired at block 506. In another embodiment, the detonator assembly 118 may be fired automatically when the detonator assembly 118 senses that the perforating gun assembly 100 has moved into the desired downhole position within the wellbore 200, and the detonator assembly 118 has transitioned into the armed state. In either embodiment, the detonator control board 302 provides a fire signal to the detonator ballistics 304, which results in the firing of the detonator ballistics 304 and subsequent detonation of the detonating cord 108 and the charges 102 of the perforating gun assembly 100.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a perforating gun assembly, comprising: a housing; at least one perforating charge disposed within the housing; a detonating cord disposed within the housing and ballistically coupled to the at least one perforating charge; and a detonator assembly disposed in line adjacent to the detonating cord, the detonator assembly comprising: a detonator; a ballistic interrupt; an actuator configured to remove the ballistic interrupt from a line of fire of the detonator; and a detonator control board configured to control the actuator and firing of the detonator.

Clause 2, the assembly of clause 1, wherein the detonator control board is configured to receive a firing signal to control firing of the detonator.

Clause 3, the assembly of clause 1 or 2, wherein the actuator removes the ballistic interrupt from the line of fire of the detonator when the perforating gun assembly is beneath a surface of a well.

Clause 4, the assembly of at least one of clauses 1-3, wherein the ballistic interrupt comprises a sheet of metal extending between the detonator and the detonating cord.

Clause 5, the assembly of at least one of clauses 1-4, wherein the detonator control board is uniquely addressable by control signals.

Clause 6, the assembly of at least one of clauses 1-5, wherein the perforating gun assembly is configured to couple to an additional perforating gun assembly.

Clause 7, the assembly of at least one of clauses 1-6, wherein the at least one perforating charge is configured to punch holes in a casing of a wellbore.

Clause 8, the assembly of at least one of clauses 1-7, wherein the ballistic interrupt comprises a distance barrier.

Clause 9, the assembly of at least one of clauses 1-8, wherein the detonator assembly is controlled using analog control that provides control signals to the detonator control board automatically based on pressure sensing, temperature sensing, liquid sensing, time from deployment of the perforating gun assembly, or any combination thereof.

Clause 10, a method to fire a perforating gun, comprising: running the perforating gun downhole within a wellbore to a desired perforating location; removing a first ballistic interrupt from a first line of fire of a first detonator of the perforating gun; and firing a first section of the perforating gun by detonating the first detonator.

Clause 11, the method of clause 10, comprising: removing a second ballistic interrupt from a second line of fire of a second detonator of the perforating gun; and firing a second section of the perforating gun by detonating the second detonator.

Clause 12, the method of clause 11, comprising: running the perforating gun within the wellbore to a second desired perforating location prior to firing the second section of the perforating gun.

Clause 13, the method of at least one of clauses 10-12, wherein the first section of the perforating gun is located further downhole than a remainder of sections of the perforating gun.

Clause 14, the method of at least one of clauses 10-13, wherein the first section of the perforating gun is located further uphole than a remainder of sections of the perforating gun.

Clause 15, the method of at least one of clauses 10-14, wherein the first detonator is uniquely addressable by control signals.

Clause 16, the method of at least one of clauses 10-15, wherein removing the first ballistic interrupt occurs when the perforating gun is below a surface of the wellbore.

Clause 17, a detonator assembly, comprising: detonator ballistics; a ballistic barrier; an actuator configured to remove the ballistic barrier from a line of fire of the detonator ballistics; and a detonator control board configured to control the actuator and firing of the detonator ballistics.

Clause 18, the detonator assembly of clause 17, wherein the ballistic barrier comprises a ballistic interrupt.

Clause 19, the detonator assembly of clause 17, wherein the ballistic barrier comprises a distance barrier.

Clause 20, the detonator assembly of clause 19, wherein removing the ballistic barrier from the line of fire of the detonator ballistics comprises moving the detonator ballistics closer to a detonating cord.

While this specification provides specific details related to certain components related to a perforating gun assembly, it may be appreciated that the list of components is illustrative only and is not intended to be exhaustive or limited to the forms disclosed. Other components related to perforating gun assemblies will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A perforating gun assembly, comprising:

a housing;

at least one perforating charge disposed within the housing;

a detonating cord disposed within the housing and ballistically coupled to the at least one perforating charge; and a detonator assembly disposed in line or adjacent to the detonating cord, the detonator assembly comprising:

a detonator;

a ballistic interrupt;

an electromechanical actuator comprising a motor configured to mechanically transport the ballistic interrupt away from a line of fire of the detonator; and a detonator control board configured to control the actuator and firing of the detonator with a control signal.

2. The assembly of claim 1, wherein the actuator removes the ballistic interrupt from the line of fire of the detonator when the perforating gun assembly is beneath a surface of a well.

3. The assembly of claim 1, wherein the ballistic interrupt comprises a sheet of metal extending between the detonator and the detonating cord.

4. The assembly of claim 1, wherein the detonator control board is uniquely addressable by control signals.

5. The assembly of claim 1, wherein the perforating gun assembly is configured to couple to an additional perforating gun assembly.

6. The assembly of claim 1, wherein the at least one perforating charge is configured to punch holes in a casing of a wellbore.

7. The assembly of claim 1, wherein the ballistic interrupt comprises a distance barrier.

8. The assembly of claim 1, wherein the detonator assembly is controlled using analog control that provides control signals to the detonator control board automatically based on pressure sensing, temperature sensing, liquid sensing, time from deployment of the perforating gun assembly, or any combination thereof.

9. A method to fire a perforating gun, comprising:

running the perforating gun downhole within a wellbore to a desired perforating location;

removing a first ballistic interrupt from a first line of fire of a first detonator of the perforating gun; wherein the removing comprises actuating an electromechanical actuator comprising a motor configured to mechanically transport the ballistic interrupt away from the first line of fire of the detonator; and firing a first section of the perforating gun by detonating the first detonator.

10. The method of claim 9, comprising:

removing a second ballistic interrupt from a second line of fire of a second detonator of the perforating gun; and firing a second section of the perforating gun by detonating the second detonator.

11. The method of claim 10, comprising:

running the perforating gun within the wellbore to a second desired perforating location prior to firing the second section of the perforating gun.

12. The method of claim 9, wherein the first section of the perforating gun is located further downhole than a remainder of sections of the perforating gun.

13. The method of claim 9, wherein the first section of the perforating gun is located further uphole than a remainder of sections of the perforating gun.

14. The method of claim 9, wherein the first detonator is uniquely addressable by control signals.

15. The method of claim 9, wherein removing the first ballistic interrupt occurs when the perforating gun is below a surface of the wellbore.

16. A detonator assembly, comprising:

detonator ballistics;

a ballistic barrier;

an electromechanical actuator comprising a motor configured to mechanically transport the ballistic barrier away from a line of fire of the detonator ballistics; and a detonator control board configured to control the actuator and firing of the detonator ballistics with a control signal.

17. The detonator assembly of claim 16, wherein the ballistic barrier comprises a ballistic interrupt.

18. The detonator assembly of claim 16, wherein the ballistic barrier comprises a distance barrier.

19. The detonator assembly of claim 18, wherein removing the ballistic barrier from the line of fire of the detonator ballistics comprises moving the detonator ballistics closer to a detonating cord.

20. The detonator assembly of claim 16, wherein the detonator assembly is controlled using analog control that provides control signals to the detonator control board automatically based on pressure sensing, temperature sensing, liquid sensing, time from deployment of the perforating gun assembly, or any combination thereof.

* * * * *